US007926745B2

(12) United States Patent
Kitagawa et al.

(10) Patent No.: US 7,926,745 B2
(45) Date of Patent: Apr. 19, 2011

(54) FUEL INJECTION VALVE

(75) Inventors: Kazunori Kitagawa, Tokyo (JP); Yoshihiko Onishi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 893 days.

(21) Appl. No.: 11/884,343

(22) PCT Filed: Nov. 27, 2006

(86) PCT No.: PCT/JP2006/023593

§ 371 (c)(1), (2), (4) Date: Aug. 15, 2007

(87) PCT Pub. No.: WO2008/065698

PCT Pub. Date: Jun. 5, 2008

(65) Prior Publication Data

US 2010/0155507 A1 Jun. 24, 2010

(51) Int. Cl.
*F02M 61/10* (2006.01)

(52) U.S. Cl. ..... 239/533.11; 239/585.5

(58) Field of Classification Search ..... 239/88–96, 239/533.2, 533.11, 533.12, 585.1–585.5, 239/584, 533.14

See application file for complete search history.

(56) References Cited

U.S. PATENT DOCUMENTS

| | | | | | |
|---|---|---|---|---|---|
| 4,982,716 | A | * | 1/1991 | Takeda et al. | 123/531 |
| 5,174,505 | A | * | 12/1992 | Shen | 239/417.3 |
| 5,544,816 | A | * | 8/1996 | Nally et al. | 239/585.5 |
| 2003/0038187 | A1 | | 2/2003 | Battistini et al. | |

FOREIGN PATENT DOCUMENTS

| | | | |
|---|---|---|---|
| JP | 56-138571 | A | 10/1981 |
| JP | 59-18587 | B2 | 4/1984 |
| JP | 9-072430 | A | 3/1997 |
| JP | 2001-107826 | A | 4/2001 |
| JP | 2002500308 | A | 1/2002 |
| JP | 2002516953 | A | 6/2002 |
| JP | 2003307165 | A | 10/2003 |

OTHER PUBLICATIONS

Japanese Office Action dated Feb. 2, 2009.

* cited by examiner

*Primary Examiner* — Davis Hwu
(74) *Attorney, Agent, or Firm* — Sughrue Mion, PLLC

(57) ABSTRACT

A fuel injection valve includes a valve seat (11) that has a valve seat portion (11*a*) with a conical space defined therein and tapered toward an injection hole (11*b*), a needle (12) that has a valve portion (12*b*) formed with a curved surface for abutment with the valve seat portion (11*a*) and a column-shaped sliding portion (12*a*) located upstream of the valve seat portion (11*a*), and a swirler (10) that holds the sliding portion (12*a*) in a slidable manner, wherein fuel to be injected from the injection hole (11*b*) is adjusted by opening and closing a gap between the valve portion (12*b*) and said valve seat (11*a*), and assuming that a radius of curvature in an axial direction of the valve portion (12*b*) at a point at which the valve portion (12*b*) and the valve seat portion (11*a*) are in abutment with each other is R and an outer diameter of the sliding portion (12*a*) is D, R is greater than D/2.

5 Claims, 4 Drawing Sheets

F: AXIAL FORCE
F1: COMPONENT OF F IN A DIRECTION OF SLOPED SURFACE
F2: COMPONENT OF F IN PERPENDICULAR TO SLOPED SURFADE

FUEL INJECTION VALVE

TECHNICAL FIELD

The present invention relates to a fuel injection valve which includes a valve seat having a valve seat portion, and a needle having a valve portion capable of abutting against the valve seat portion, and which serves to adjust fuel to be injected from an injection hole by opening and closing a gap between the valve seat portion and the valve portion.

BACKGROUND ART

In the past, there has been known a fuel injection valve which includes a valve seat that has a valve seat portion with a conical space defined therein and tapered toward an injection hole, and a needle that has a valve portion in abutment against the valve seat portion, wherein fuel injected from the above-mentioned injection hole is adjusted by opening and closing a gap between the above-mentioned valve portion and the above-mentioned valve seat portion (see, for example, a first patent document).

In particular, there has been known one that has a valve portion formed into a semi-spherical shape.

[First Patent Document]

Japanese patent application laid-open No. 2001-1 07826

DISCLOSURE OF THE INVENTION

Problems to be Solved by the Invention

However, in general, the higher fuel is pressurized, contact stress between a valve portion and a valve seat portion increases. In particular, in case where the valve portion is semi-spherical, in order to suppress an increase in such contact stress, it is necessary to make larger the diameter of an abutment or contact circle between the valve portion and the valve seat portion so as to increase a contact area therebetween, and hence the radius of the valve portion has to be made larger. However, if the radius of the valve portion is made larger, the diameter of the needle also becomes larger, and the weight of the needle is increased, thus giving rise to a problem that the response of the fuel injection valve is deteriorated.

The present invention is intended to obviate the problems as referred to above, and has for its object to provide a fuel injection valve which is capable of suppressing an increase in contact stress between a valve portion and a valve seat portion without deteriorating its response even if fuel is pressurized to a high pressure.

Means for Solving the Problems

A fuel injection valve according to the present invention includes a valve seat that has a valve seat portion with a conical space defined therein and tapered toward an injection hole; a needle that has a valve portion formed with a curved surface for abutment with said valve seat portion and a column-shaped sliding portion located upstream of said valve seat portion, and a guide body that holds said sliding portion in a slidable manner, wherein fuel to be injected from said injection hole is adjusted by opening and closing a gap between said valve portion and said valve seat portion, and assuming that a radius of curvature in an axial direction of said valve portion at a point at which said valve portion and said valve seat portion are in abutment with each other is R and an outer diameter of said sliding portion is D, R is greater than D/2.

Effects of the Invention

According to a fuel injection valve of the present invention, it is possible to suppress an increase in contact stress between a valve portion and a valve seat portion without deteriorating its response even if fuel is pressurized to a high pressure.

BEST MODE FOR CARRYING OUT THE INVENTION

Embodiment 1

Figure 1:
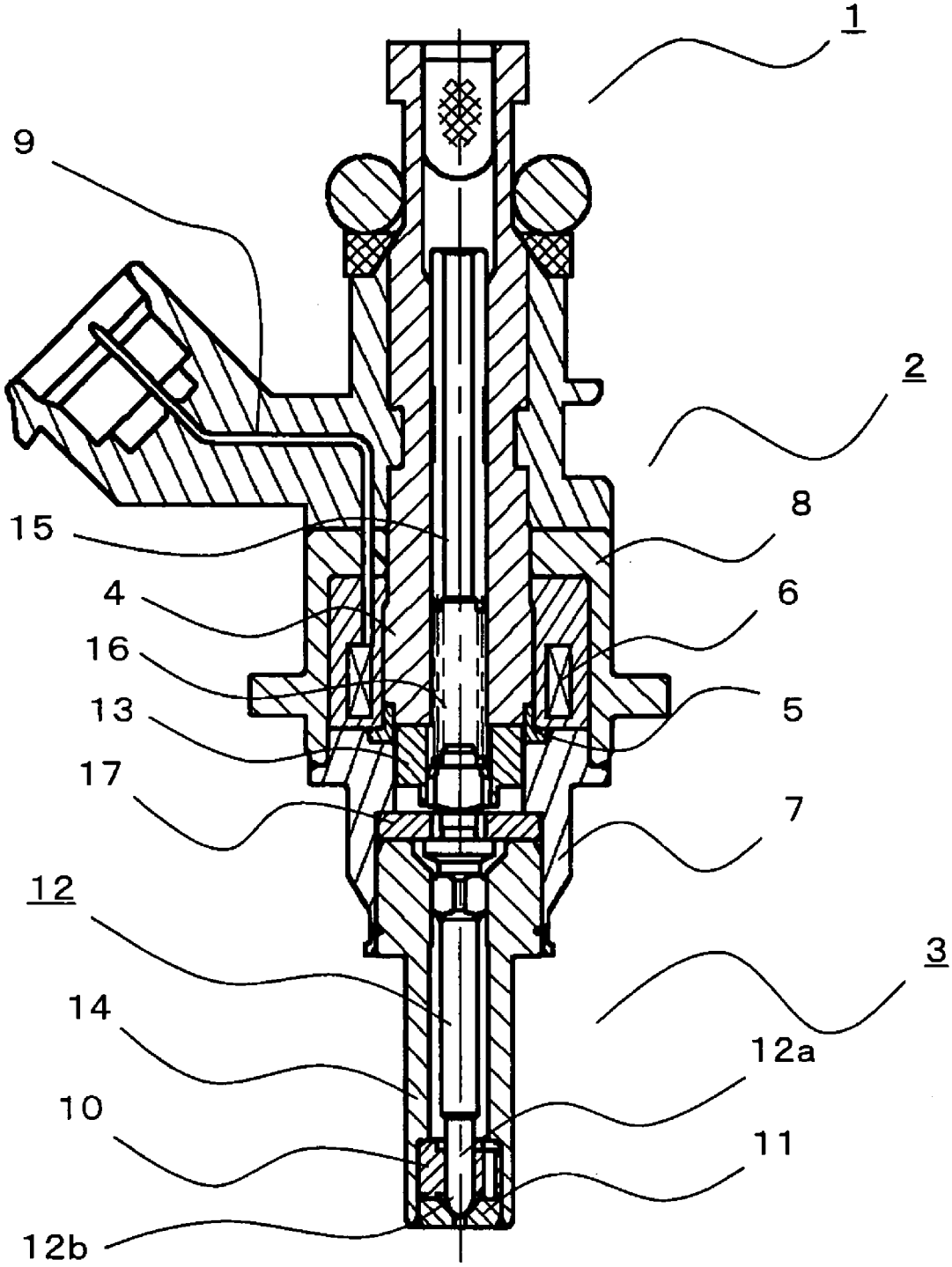
FIG. 1 is a cross sectional view of a fuel injection valve according to a first embodiment.
Figure 2:
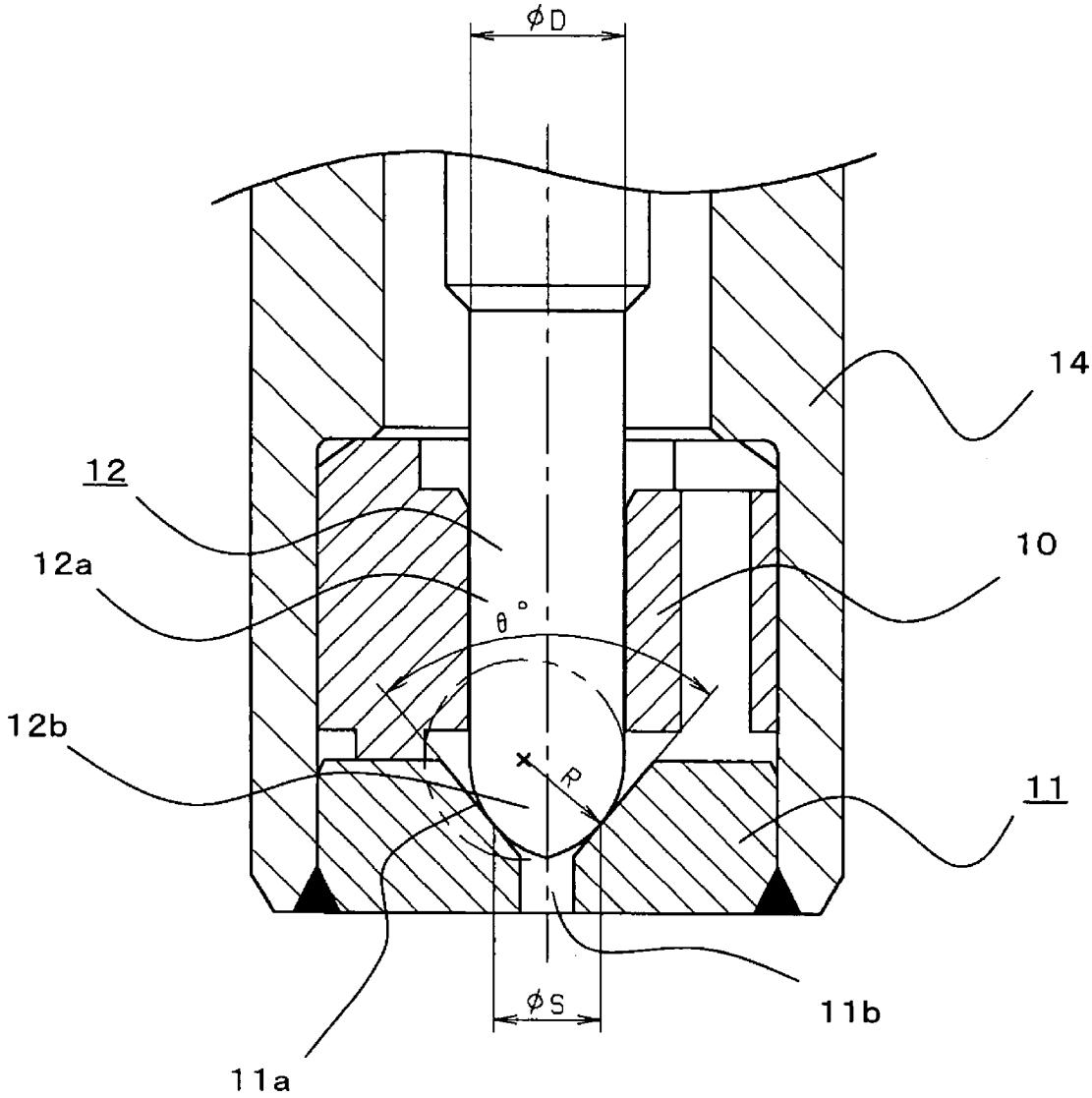
FIG. 2 is an enlarged view of essential portions of the fuel injection valve of FIG. 1.

FIG. 1 is a cross sectional view of a fuel injection valve 1 according to a first embodiment of the present invention. FIG. 2 is an enlarged view of essential portions of the fuel injection valve 1 of FIG. 1. The fuel injection valve 1 according to the first embodiment is provided with a solenoid portion 2 that generates an electromagnetic force, and a valve main body 3 that is opened and closed by the electromagnetic force of the solenoid portion 2 for adjusting the injection of fuel.

The solenoid portion 2 includes a core 4 of a hollow cylindrical shape, a ring 5 of a nonmagnetic material arranged at an end of this core 4, a coil 6 that arranged at an outer side of the core 4, a holder 7 of a nonmagnetic material arranged at an under side of the ring 5 and the coil 6, a housing 8 of a nonmagnetic material arranged at an outer side of the coil 6, and a rod 15 arranged at inner side of the core 4.

The coil 6 is connected to a terminal 9 so that it can be energized by being supplied with an electric current from the outside.

The valve main body 3 includes a swirler 10 in the form of a guide body that generates a swirling flow in fuel, a valve seat 11 that has a valve seat portion 11*a* with an injection hole 11*b* formed therethrough, a needle 12 that extends through the swirler 10 and is able to abut against the valve seat portion 11*a*, and an armature 13 that is fixedly secured to an end of the needle 12 at the core 4 side and is slidable along the axial direction of the core 4 with respect to the holder 7.

The valve seat portion 11*a* defines therein a conical space tapered toward the injection hole 11*b*.

The needle 12 has a sliding portion 12*a* that is slidably held in the swirler 10 and a valve portion 12*b* that is able to abut against the valve seat portion 11*a*.

A body 14 having the valve main body 3 received therein is arranged at an outer side of the valve main body 3.

A spring 16 is arranged between the rod 15 and the armature 13 so that the needle 12 is urged in a direction toward the valve seat portion 11*a* by this spring 16.

A stopper 17 for restricting an amount of lift of the needle 12 is arranged at a core 4 side of the body 14, so that when a flange portion formed on the needle 12 is placed in abutment against the stopper 17, an opening area between the valve portion 12*b* and the valve seat portion 11*a* become a maximum.

At the time when this fuel injection valve 1 is closed, high pressure fuel is filled around the needle 12 so that the valve portion 12*b* is urged to the valve seat portion 11*a* by a force that is the sum of the urging force of the spring 16 and the pressure of fuel.

When the coil 6 is excited by a valve-opening signal from an unillustrated control controller, the core 4 is magnetized so that an attractive force to the armature 13 and the needle 12 is generated by this core 4.

When this attractive force becomes larger than the above-mentioned force that acts to urge the valve portion 12*b* to the valve seat portion 11*a*, the valve portion 12*b* is moved away from the valve seat portion 11*a* so as to be opened.

The radius of curvature R in the axial direction at a point at which the valve portion 12*b* abuts against the valve seat portion 11*a* is formed so as to satisfy the following expression (1) with an assumption that the diameter of the sliding portion 12*a* is D.

$$R>D/2 \quad (1)$$

In a microscopic viewpoint, in a state where the valve portion 12*b* is deformed by being urged or pressed against the valve seat portion 11*a*, the contact area between the valve portion 12*b* and the valve seat portion 11*a* increases in accordance with the increasing radius of curvature R of the valve portion 12*b*. Accordingly, the contact stress between the valve portion 12*b* and the valve seat portion 11*a* becomes smaller, as a result of which even if fuel is pressurized to a high pressure, it is possible to suppress the increase of the contact stress between the valve portion 12*b* and the valve seat portion 11*a*.

The valve portion 12*b* has a maximum outer diameter identical to the outer diameter of the sliding portion 12*a*, and the outer diameter of the valve portion 12*b* gradually decreases toward its tip end. As a result, upon assembly of the needle 12, it can be easily inserted into the swirler 10. In addition, the misalignment or deviation of axis of the valve portion 12*b* can be reduced.

Assuming that a seat diameter in the form of the diameter of an abutment or contact circle in which the valve seat portion 11*a* and the valve portion 12*b* are in abutment with each other is S and a seat angle in the form of an inner angle at the vertex of the conical space of the valve seat portion 11*a* is θ, the radius of curvature R satisfies the following expression (2).

$$S<2\times R\times\sin(90\text{ degrees}-\theta/2) \quad (2)$$

When the seat diameter S is decreased, the force to urge the valve portion 12*b* to the valve seat portion 11*a* due to the fuel pressure becomes smaller, so it is possible to suppress the increase of an attractive force required to lift the needle 12 from the valve seat 11 even if fuel is pressurized to a high pressure.

In addition, since the increase of the attractive force can be suppressed, it is unnecessary to enlarge the solenoid portion 2 so as to produce a larger attractive force even if fuel is pressurized to the high pressure, and hence it is possible to suppress the increase in size of the fuel injection valve 1 as a whole.

Figure 3:
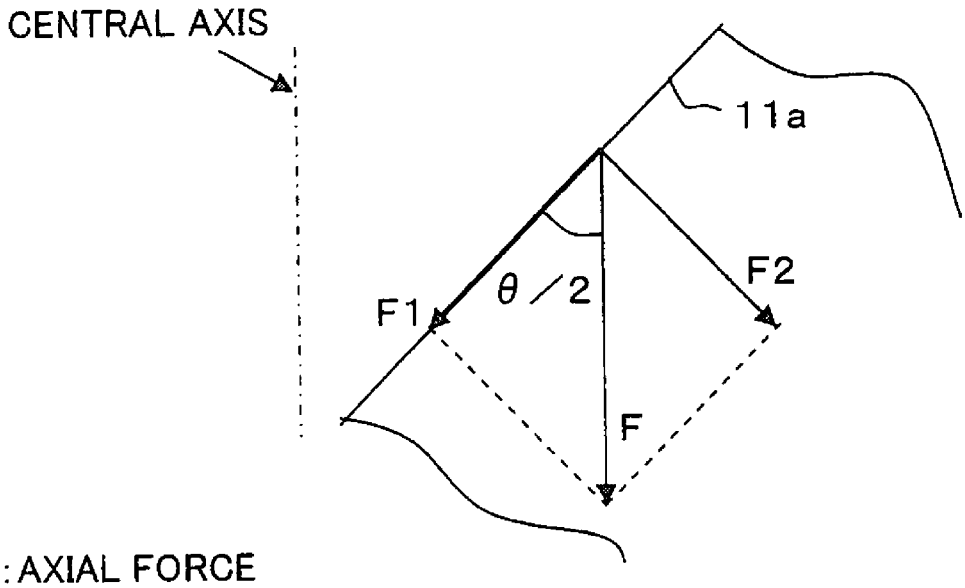
FIG. 3 is an explanatory view showing the relation between the seat angle of a valve seat portion and the center adjusting force of a needle of FIG. 1.

Although there is a method of obtaining an attractive force required to slide the needle 12 by making the seat angle θ larger while decreasing the seat diameter S, an alignment or centering force F1 acting on the needle 12 is represented by the following expression (3), as shown in FIG. 3, so the alignment or centering of the needle 12 becomes smaller in accordance with the increasing seat angle θ, thus resulting in unstable operation of the needle 12.

$$F1=F\cos(\theta/2) \quad (3)$$

Accordingly, the inventor of the subject application has found it appropriate or optimal to adjust the seat angle θ to a range of 80 degrees to 100 degrees from the viewpoint of balancing the alignment or centering of the needle 12 and the machinability of the valve seat portion 11*a*.

In a state where the valve portion 12*b* is urged or pressed against and deformed by the valve seat portion 11*a*, the contact area between the valve portion 12*b* and the valve seat portion 11*a* increases in accordance with the increasing radius of curvature R of the valve portion 12*b*. Accordingly, the contact stress between the valve portion 12*b* and the valve seat portion 11*a* becomes smaller, so the degradation of the valve portion 12*b* and the valve seat portion 11*a* can be suppressed, but closing or sealing between the valve portion 12*b* and the valve seat portion 11*a* at the time of valve closure is deteriorated. In general, it is preferable that the contact stress between the valve portion 12*b* and the valve seat portion 11*a* be in a range of 400 MPa to 600 MPa.

Figure 4:
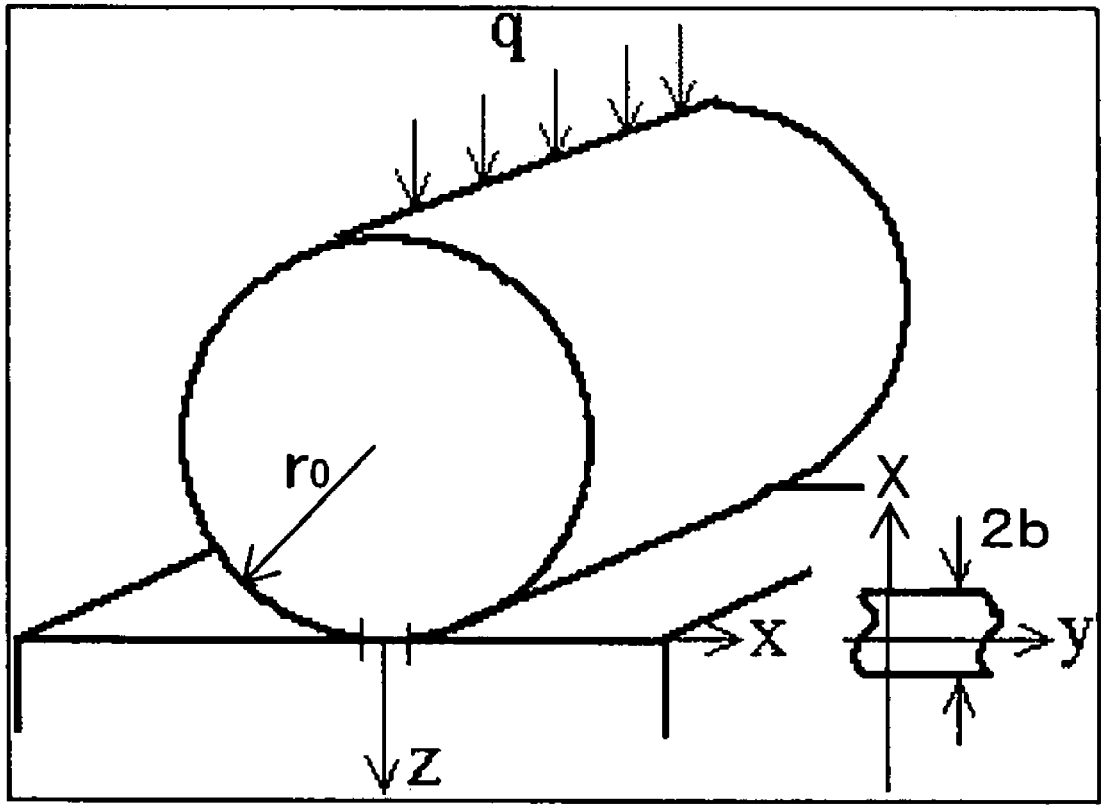
FIG. 4 is an explanatory view showing a model for calculation of contact stress by using a circular column and a plane.

As shown in FIG. 4, the following expression (4) is derived, according to Hertz's law, from the relation between the contact stress, which is generated between the circular column and the plane being in contact with each other, and the radius of curvature R of the circular column. Here, note that the line load per unit length in the abutment portion is Q; the modulus of longitudinal elasticity of the valve portion 12*b* is $E_1$; the modulus of longitudinal elasticity of the valve seat portion 11*a* is $E_2$; the Poisson's ratio of the valve portion 12*b* is $\nu_1$; the Poisson's ratio of the valve seat portion 11*a* is $\nu_2$; and the contact stress due to the abutment between the valve portion 12*b* and the valve seat portion 11*a* is P.

$$R=(1/\pi)\times(Q/P^2)\times 1/\{(1-\nu_1^2)/E_1+(1-\nu_2^2)/E_2\} \quad (4)$$

By using this expression (4), the radius of curvature of the valve portion 12*b* can be easily calculated according to the materials and working conditions for the valve seat 11 and the needle 12.

In actuality, the inventor of the subject application calculated the radius of curvature R by using the above expression (4) with the following assumption: that is, the moduli of longitudinal elasticity $E_1$, $E_2$ are 200 GPa; the Poisson's ratios $\nu_1$, $\nu_2$ are 0.3; and the contact stress P is 400 MPa to 600 MPa.

Here, the moduli of longitudinal elasticity $E_1$, $E_2$ are the modulus of longitudinal elasticity for martensite type stainless steel, which is generally used as a material for the valve portion 12*b* and the valve seat portion 11*a*.

In addition, the line load Q is calculated with the following assumption: that is, the force applied by the urging force of the spring 16 to an osculating circle between the valve portion 12*b* and the valve seat portion 11*a* is 15 N to 20 N; the pressure applied by high pressure fuel to the osculating circle between the valve portion 12*b* and the valve seat portion 11*a* is 15 MPa to 20 MPa; and the seat diameter S is 1.2 mm to 1.4 mm.

As a result, by setting the radius of curvature R to be between 1.0 mm and 1.5 mm, it is possible to obtain an appropriate contact stress between the valve portion 12*b* and the valve seat portion 11*a* at the time of valve closure, which serves to suppress the degradation of the valve portion 12*b* and the valve seat portion 11*a* as well as the deterioration of closing or sealing therebetween.

The invention claimed is:

1. A fuel injection valve comprising:

a valve seat that has a valve seat portion with a conical space defined therein and tapered toward an injection hole;

a needle that has a valve portion formed with a curved surface for abutment with said valve seat portion and a column-shaped sliding portion located upstream of said valve seat portion; and a guide body that holds said sliding portion in a slidable manner;

wherein fuel to be injected from said injection hole is adjusted by opening and closing a gap between said valve portion and said valve seat portion;

wherein, assuming that a radius of curvature in an axial direction of said valve portion at a point at which said valve portion and said valve seat portion are in abutment with each other is R and an outer diameter of said sliding portion is D, R is greater than D/2, and wherein, assuming that a seat diameter in the form of the diameter of an abutment circle in which said valve seat portion and said valve portion are in abutment with each other is S and a seat angle in the form of an inner angle at a vertex of said conical space is θ, the following expression is satisfied:

$$S<2\times R\times\sin(90\text{ degrees}-\theta/2).$$

2. The fuel injection valve as set forth in claim 1, wherein said valve portion has a maximum outer diameter identical to the outer diameter of said sliding portion, and the outer diameter of said valve portion gradually decreases toward its tip end.

3. The fuel injection valve as set forth in claim 1, wherein said seat angle θ is 80 degrees $\leqq\theta\leqq$100 degrees.

4. The fuel injection valve as set forth in claim 1, wherein a line load per unit length in said abutment circle is Q; a modulus of longitudinal elasticity of said valve portion is $E_1$; a modulus of longitudinal elasticity of said valve seat portion is $E_2$; Poisson's ratio of said valve portion is $\nu_1$; Poisson's ratio of said valve seat portion is $\nu_2$; and a contact stress due to abutment between said valve portion and said valve seat portion is P, said radius of curvature R is calculated from the following expression:

$$R=(1/\pi)\times(Q/P^2)\times 1/\{(1-\nu_1^2)/E_1+(1-\nu_2^2)/E_2\}.$$

5. The fuel injection valve as set forth in claim 4, wherein said radius of curvature R is as follows: 1 mm$\leqq$R$\leqq$1.5 mm.

* * * * *